US006648331B2

(12) United States Patent
Stuart

(10) Patent No.: US 6,648,331 B2
(45) Date of Patent: Nov. 18, 2003

(54) INTERACTIVE QUESTION AND ANSWER WORD DEDUCTION GAME

(76) Inventor: Patricia R. Stuart, 13421 N. 43 Ave., Apt. 1069, Phoenix, AZ (US) 85029

( * ) Notice: Subject to any disclaimer, the term of this patent is extended or adjusted under 35 U.S.C. 154(b) by 0 days.

(21) Appl. No.: 09/982,131

(22) Filed: Oct. 17, 2001

(65) Prior Publication Data

US 2003/0071419 A1 Apr. 17, 2003

(51) Int. Cl.[7] ..... A63F 3/00
(52) U.S. Cl. ..... 273/430; 273/272; 434/174
(58) Field of Search ..... 434/173, 174; 273/429, 430, 431, 432, 272, 293, 294, 302

(56) References Cited

U.S. PATENT DOCUMENTS 3,460,273 A * 8/1969 Boyd
4,315,627 A * 2/1982 Schlegel et al.
4,389,193 A * 6/1983 Phillips
4,509,758 A * 4/1985 Cole
4,643,680 A * 2/1987 Hill
4,971,561 A * 11/1990 Krane
5,746,431 A 5/1998 McIntyre et al.
5,797,601 A * 8/1998 Ritchie
5,913,518 A 6/1999 Demlow
5,951,010 A * 9/1999 Ordinas
6,120,032 A 9/2000 Wissinger
6,224,057 B1 5/2001 Morton
6,267,376 B1 7/2001 Jenkins

* cited by examiner

*Primary Examiner*—William M. Pierce
(74) *Attorney, Agent, or Firm*—Tod R. Nissle, P.C.

(57) ABSTRACT

An educational interactive word game is played utilizing only a single game card. During the game a first player, after being given clues by a second player to the identity of a selected object exercises his or her deductive skills by asking questions of the second player to gain background information about the subject. After obtaining background information, the first player guesses the identity of the selected object.

3 Claims, 2 Drawing Sheets

INTERACTIVE QUESTION AND ANSWER WORD DEDUCTION GAME

CROSS-REFERENCES TO RELATED APPLICATIONS

Figure 1:
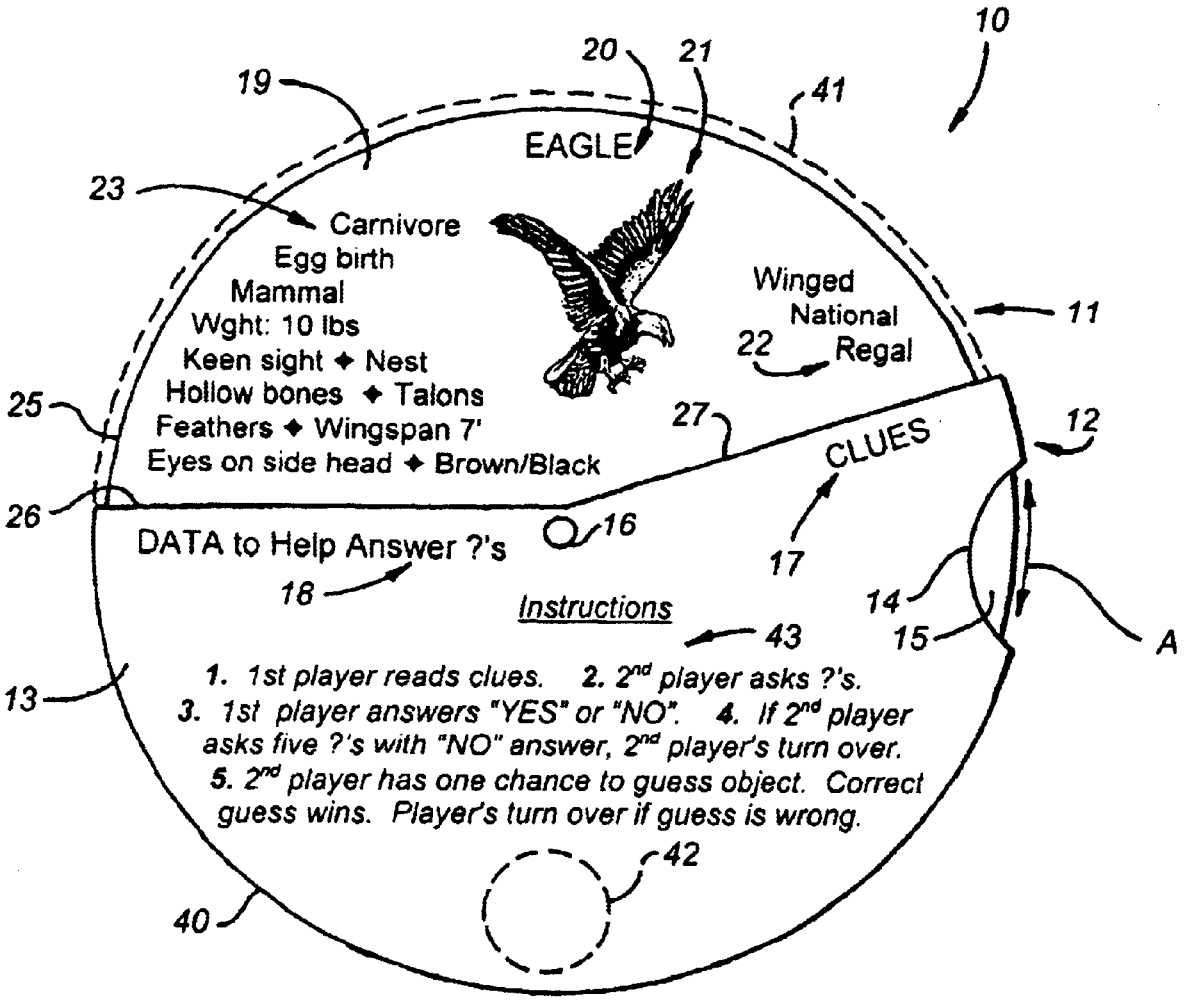

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention.

This invention pertains to games.

More particularly, this invention pertains to an educational interactive word game to deduct the identification of a selected subject and to educate the players of the game about the subject.

In another respect, the invention pertains to an educational interactive word game which can be played utilizing only a single game card.

In a further respect, the invention pertains to an educational interactive word game which requires manual dexterity to select one of a plurality of subjects contained on a single playing card.

In still another respect, the invention relates to an educational interactive word game in which a second player, after being given clues to the identity of a selected object, exercises his or her deductive skills by asking at least a first question of the first player to gain background information about the subject and not to specifically identify the subject.

In yet a further respect, the invention pertains to an educational interactive word game in which a first player provides to a second player clues to the identification of a selected subject, in which at least a first question is asked of the first player by the second player to be answered yes or no, and in which another question is asked of the first player by the second player to identify to selected object.

In yet still another respect, the invention pertains to an educational interactive word game in which different subjects are selected by altering the orientation of a face of a playing card.

In a further respect, the invention pertains to an educational interactive word game in which portions of a playing card are concealed and others are exposed to view while the game is being played using information on the card.

In another respect, the invention pertains to an educational interactive word game in which a first player provides clues to a second player concerning the identity of a particular object, but in which the first player does not ask questions of the first player and does not suggest a particular category in which the object is included.

2. Description of the Related Art including information disclosed under 37 CFR 1.97 and 1.98.

Games which utilize questions and answers are well known. Such games typically require a player to produce the correct answer within a set period of time. In the Jeopardy (SM) TV game, a player answers with a "what is" question. In the Wheel of Fortune TV game, a contestant is given a clue in the form of the identification of a category of information, and contestants then guess at the correct answer by supplying letters of the alphabet in an attempt to spell the answer.

U.S. Pat. No. 6,120,032, issued Sep. 19, 2000, discloses a game having a display of alphanumeric combinations, and a device containing at least one category of subjects involving questions and correct answers to the questions in the form of clues provided by the numbers of the alphanumeric combination contained in the display. One embodiment of the invention is described in claim 1 of the patent:

1. A game comprising
   - a display of letter and number combinations wherein each number of the letter/number combinations represents a predetermined group of letter, and
   - means separate from the displya of the letter/number combination for presenting a subject to a player of the game involving a questions and a correct answer to said question, and clues to the correct answer, said clues being provided by numbers of the letter/number combinations that represent the letters of the correct answer.

Another embodiment of the invention is described in claim 18:

18. A game apparatus comprising
   - a game board having a layout of a telephone keyboard wherein single numbers represent a group of letters, and
   - at least one category of subjects involving questions and answers to said questions wherein the answers are provided in the form of representative numbers selected from the numbers found on the game board,
   - the correct answer to a given question being determined by a combination of said numbers that represent the letters that correctly spell the answer.

U.S. Pat. No. 5,746,431, issued May 5, 1998, describes a question and answer football game. The game provides a complete game for individual institutions and/or teams. Players compete by answering questions which are inscribed on play cards. The play cards are divided into categories according to progressive levels of difficulty. The game can be played by one individual, two individuals, or two groups of individuals. The game may be played using data from one or two institutions. A score card is used by the offensive player to record the results of each play attempted, the outcome, points scored and total score. The defensive player reads questions from cards drawn from the four categories requested by the offensive player or team. More difficult questions are worth more yards gained. Kick cards are used for punt, kick off, field goal, and extra point attempts. A team marker is placed on a game board which resembles a football field and provides yard markers for visual reference of player progress. As points are scored, they are tabulated on a score card. The game follows standard football rules and conventions. Kick cards and play cards are arranged in a game box. One embodiment of the invention is set forth in claim 1:

1. A method of playing an educational, question and answer sports game based on a player's knowledge of factual sports information about a sport or an institution, comprising
   - providing at least one set of cards including a plurality of playing cards having indicia representing progressive numerical levels of advancement representing yards advanced in regards to reaching an objective of said game wherein each said playing card includes a written question corresponding to said indicia representing the progressive numerical levels of advancement representing yards advanced, and said written question being about factual information pertaining to a particular sports team and a written answer responsive to said written question wherein said written questions have degrees of difficult corresponding to said progressive numerical levels of advancement, selecting said playing cards by a respective player in accordance with a level of advancement desired to be achieved by the player;

answering the question by the player;

monitoring an answer by the player and an advancement of said player toward said game objective in response to whether said player's answer to said corresponding questions embodied on said playing cards is correct;

repeatedly selecting said playing cards and adding the numerical levels of advancement for correct answers until the player achieves a first down by advancing at least a total of ten years in four or less selections of the playing cards or achieves a touchdown;

providing a set of kick cards which include kick instructions; and, drawing one of said kick cards as an option after failing he achieve a total of at least ten yards in three or less selections of the playing cards.

Another embodiment of the invention is set forth in claim 4:

4. The method of claim 1 including the step of turning over the selection of playing cards to a second player in accordance with the kick instructions on said kick card as drawn by a first player whereby said second player resumes play of the game in accordance with the selection of said playing card and the answering of said questions until said second player either fails to achieve a first down by advancing at least a total of ten yards in four or less selections or scores a touchdown.

A further embodiment of the invention is set forth in claim 6:

6. The method of claim 1 wherein said game includes recording a number of a down, a number of yards to go for a first down, and a present location of a football for a first player representing the advancement of the first player;

indicating the level of advancement yardage gain attempted by the first player on the present down;

selecting a playing card by said second player corresponding to the degree of difficult selected by said first player, said second player asking the question written on said playing card to said first player;

said second player checking the answer of said first player against said answer written on said playing card; and, recording any yardage gained by said first player in response to the correctness of his answer to said question.

U.S. Pat. No. 6,224,057, issued May 1, 2001, describes a game which merges two game formats into a unique and novel game comprising a game board and playing pieces. The playing pieces are used by the players to mark the movement of the players as the players advance around the game board. During each turn, the player must answer a question and construct a list of words based upon the letters in the correct answer. The player accumulating a predetermined number of points is declared the winner. Claim 1 describes one embodiment of the invention:

1. A method of playing a game comprising the steps of:

providing a game board having a plurality of playing spaces defined thereon, said playing spaces defining a playing path; said playing spaces containing therein indicia of one of one or more subject categories, said game board further having a starting playing space located on said playing path;

providing one or more card spaces, wherein the number of said card spaces are at least equal to the number of said subject categories;

providing a plurality of question cards in stacks upon said card spaces so that all question cards pertaining to each of said plurality of subject categories are placed upon said corresponding card space, said stacks having a topmost card;

providing a plurality of playing pieces, each of said playing pieces being used to represent one of a plurality of players, said playing pieces being positioned on the starting playing space at the start of the game;

providing a means for randomly generating a number, wherein each player in turn generates a random number, advances his playing piece along the playing path the same number of playing spaces as the random number;

presenting to the player the question on the topmost card in said stack of question cards which corresponds to the subject category on the playing space occupied by the player's piece;

the player answers the question, and if the answer is correct, constructs a word list based upon the letters in the correct answer;

evaluating said word list and awarding points to the player based upon the number and nature of the words constructed wherein the first player to receive a predetermined number of points is declared the winner of the game.

U.S. Pat. No. 5,913,518, issued Jun. 22, 1999, describes a game for entertainment as well as learning. The game is provided on a case which also serves as a storage container. One side of the case has a field of play that simulates a real life game. Game pieces are provided on the other side and include questions on cards that must be answered correctly for a player to have a chance to advance a token on the field of play. The answer to the questions is revealed in an answer window. Spinners are provided with markings to indicate the movement of the token. The rules of the game are variable to be suited to the age group of the players. Claim 1 describes one embodiment of the invention:

1. A method of playing a board game whereby players play a game and learn a sport represented by the game, which comprises:

(a) providing a game board with a playing surface having indicia consisting of only one field of play representing a sporting event played by opposing teams on the field of play, providing a plurality of tokens, assigning one or more tokens to each player, each player placing their one or more tokens on at least one starting position on said field of play, wherein each token represents an opposing team in a sporting event played on said field of play, said field of play having indicia representing spaces or positions of advancement dispersed about the field of play wherein different directions of movement are possible including a forward direction of movement, said field of play having two goal positions at opposite ends of the field of play or a common goal position for all players, assigning said goal position for each player or players to advance toward, providing playing cards having questions relating to the sport event and a chance selection device providing a random chance of advancement on the field of play;

(b) assigning one of the players an advancement opportunity, and selecting a playing card having questions that challenge the player's knowledge of the sport event, the correct answer allowing the player to make a chance selection on said chance selection device;

(c) said player making a chance selection on said chance selection device;

(d) advancing an advancement token which is moved on the field of play having varying consequences as determined by the chance selection device and the starting positions of the tokens;

(e) said player repeating the steps of (b), (c), and (d) until one or more questions are answered incorrectly or one or more chance selection or advancements of the advancement token dictates termination of the play of the player;

(f) shifting the advancement opportunity to the other player and the other player pursuing steps b–e; and, (g) continuing the alternation of players until the game is concluded.

U.S. Pat. No. 6,267,376, issued Jul. 31, 2001, describes a trivia game. The game includes a game board having a plurality of linear playing paths extending from one end of the board to the other, and includes a plurality of question and response cards each having a series of questions of differing levels of difficulty and corresponding answers. Players may select whichever level of difficulty they may wish, with advance of that player's position marker along the corresponding playing path, depending upon the degree of difficulty of the question correctly answered. The position marker of a player incorrectly answering a question is set back a number of positions corresponding to the degree of difficulty of the question. The game also allows players to set back the progress of an opposing player, if desired. A player correctly responding to a question at a predetermined level (e.g., the highest level) may advance his/her own position marker accordingly, or may elect to set back an opponent's marker some number of spaces (e.g., half the number of spaces which could otherwise be advanced). The ability to set back the progress of a leading player adds considerably to the excitement and suspense of the present game. The rules may be applied to a travel version, with score being kept conventionally (paper and pencil, etc.), and with points being added and subtracted according to the rules of play. The present game could be applied to virtually any subject matter, but is particularly well suited for television trivia, especially current and/or retired situation comedies. Claim 1 describes one embodiment of the invention:

1. A method of playing a board game, comprising the following steps:

(a) providing a game board having a plurality of parallel, linear playing paths thereon extending from a common starting edge of the board to the opposite common finishing edge, with each of the playing paths divided into an equal number of positions;

(b) further providing a plurality of question and response cards, with each of the cards including at least a plurality of questions of differing levels of difficult and answers corresponding to the questions;

(c) selecting at least one first and at least one second player, and determining an order of play among the players;

(d) randomly selecting a question and response card by the first player, and reading at least the differing levels of difficulty to the second player;

(e) selecting the level of difficult of the question to be asked of the second player, by the first player;

(f) asking a question of the second player by the first player, corresponding to the level of difficult selected by the second player;

(g) moving the second player position marker forward or the position marker of an opponent backward a number of spaces according to a correct response to the question and level of difficult of the question, or moving the second player position mark backward a number of spaces according to an incorrect response to the question and level of difficulty of the question;

(h) having the first player take a turn in the same manner described for the second player; and, (i) continuing in the above described manner until one of the players reaches the finishing edge of the game board.

One disadvantage of prior art games is that they require a playing board, playing pieces, cards, etc. If the board or playing pieces or cards are misplaced, the game is often rendered unusable. Another disadvantage of prior art games is that using game boards and pieces and cards is often awkward or inappropriate. For example, Monopoly, Risk and other board games are not games that can be readily played while ordering and eating a meal in a restaurant. Such games normally are also impractical to use while traveling in an automobile, airplane, or other vehicle. A further disadvantage of prior art games is that for players to participate, each player must manually manipulate or use a game piece, a scorecard, a pencil, or some other physical object. Having to account for and have available such physical objects makes it more difficult to find a practical time and place to play the game. Still another disadvantage of prior art "question and answer" games is that only the player in control of the question cards asks questions, and, only the player answering the question is using his memory, reasoning, or deduction to answer a question.

Accordingly, it would be highly desirable to provide an improved educational, interactive word game which would not require a board or playing pieces or multiple cards, which could readily be played at home or while traveling or in restaurants, which would not require that all the players in the game manipulate a physical object, and which would enable both the player asking questions and the player answering questions to participate Therefore, it is a principal object of the instant invention to provide an improved game method and apparatus.

BRIEF DESCRIPTION OF THE SEVERAL VIEWS OF THE DRAWING(S)

Figure 2:
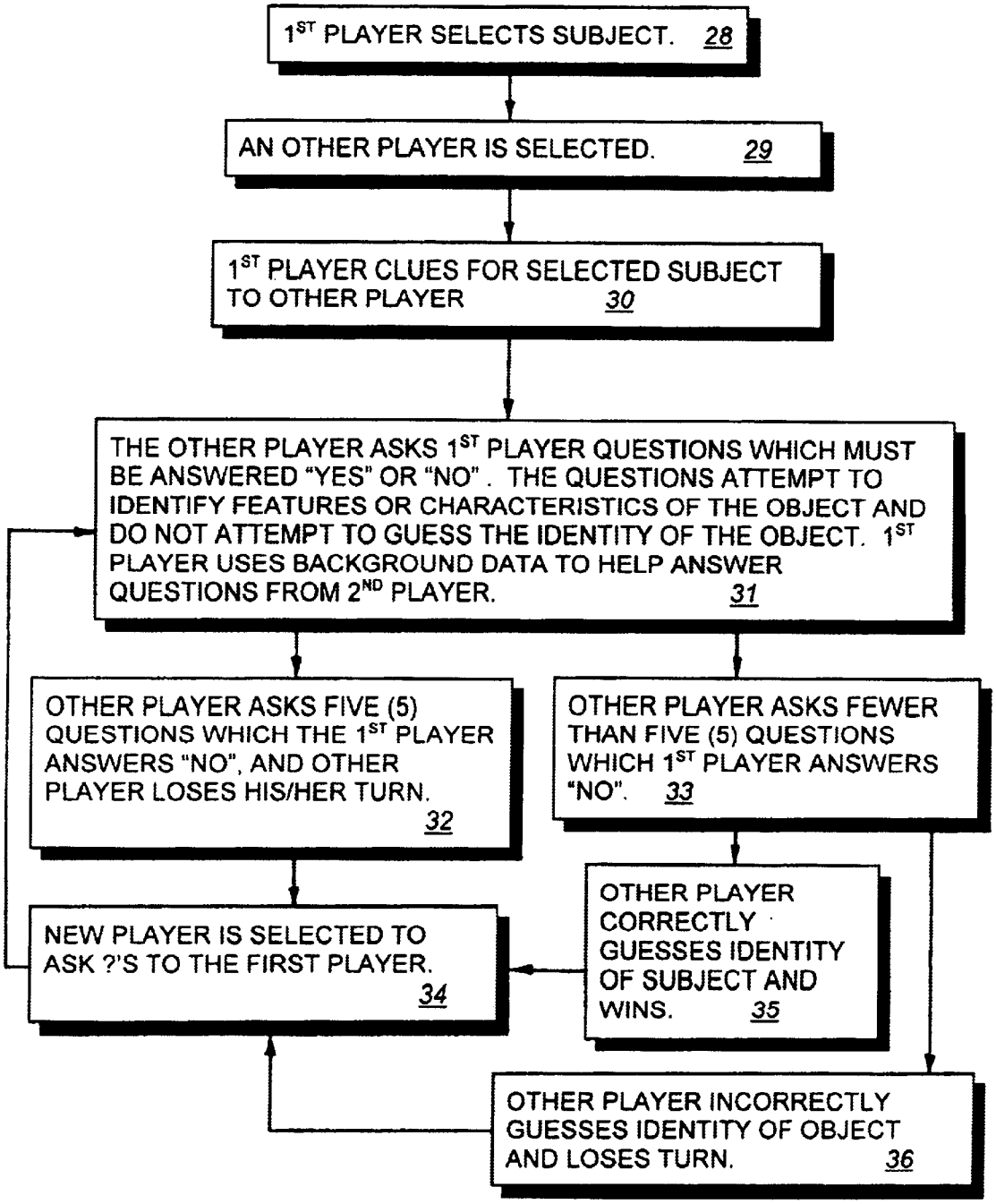

These and other, further and more specific objects and advantages of the invention will be apparent from the following detailed description of the invention, taken in conjunction with the drawings, in which:

FIG. 1 is a front view illustrating a game card rotatably mounted in a sleeve which exposes a portion of the card and conceals the remainder of the card; and, FIG. 2 is a block flow diagram illustrating one method of playing the game of the invention.

BRIEF SUMMARY OF THE INVENTION

Briefly, in accordance with my invention, I provide an improved method of playing a game. The improved method includes the steps of providing a game unit comprising at least one selected subject, word clues to the identification of the selected subject, and words comprising background information concerning the selected subject; selecting at least one first and one second player; providing the game unit to the first player; providing at least one of the clues on the game unit to the second player by the first player; asking at least a first question of the first player by the second player to gain at least a portion of the background information about the selected subject, the first player checking the correctness of the first question against the background information on the game unit; and, asking, according to a correct response by the first player to the first question, a second question of the first player by the second player to identify the selected subject, the first player checking the correctness of the second question against the selected subject on the game unit.

In accordance with another embodiment of the invention, I provide an improved game. The game includes a cover; at least one opening formed in the cover; an information card mounted adjacent the cover; at least a first display formed on a first portion of the information card and positioned in the opening for viewing. The first display includes a selected subject; background information about the selected subject to confirm to a player of the game involving at least one question concerning the background information the correctness of the question in identifying background information; and, word clues to the identification of the selected subject to confirm to a player of the game involving at least one question concerning the identification of the selected subject the correctness of the question in identifying the selected subject.

In a further embodiment of the invention, I provide an improved game. The game includes at least one playing card; and, at least a first display formed on a first portion of the playing card. The display includes a selected object; a first grouping of words separate from the selected object and describing background information about the selected object to confirm to a player of the game involving at least one question concerning the background information the correctness of the question in identifying background information; and, a second grouping of words separate from the first grouping of words and the selected object. The second grouping of words comprises clues to the identification of the selected object to confirm to a player of the game involving at least one question concerning the identification of the selected subject the correctness of the question in identifying the selected subject. The playing card does not have questions formed thereon. The game also includes symbols on the playing card identifying the first grouping of words as background information; and, symbols on the playing card identifying the second grouping of words as clues.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a game unit generally identified by reference character 10 and including a circular information or playing card 11 mounted in a generally semicircular sleeve 12. Sleeve 12 includes a front cover portion 13 and a back cover portion (not visible) which has a shape and dimension equivalent to that of portion 13. The front and back cover portions co-terminate and are connected along arcuate peripheral edge 40. Portion 13 includes edges 26 and 27. Edges 26 and 27 extend along the opening formed through sleeve 12. This opening permits the portion of card 11 above edges 26 and 27 in FIG. 1 to be viewed by the user, i.e., permits the drawing 21 of the eagle to be viewed, permits the word "EAGLE" 20 to be viewed, permits the first clue word grouping 22 of words ("Winged, National, Regal") to be viewed, and permits the second information word grouping 23 of words ("Carnivore, Egg birth, Mammal, Wght: 10 lbs, Keen sight✦Nest, Hollow bones✦Talons, Feathers✦Wingspan 7', Eyes on side head✦Brown/Black") to be viewed. This opening in sleeve 12 is formed by cutting off the upper portion of circular sleeve 12, including the portion of peripheral edge 40 indicated by dashed lines 41 in FIG. 1. An opening, for example, the opening indicated by dashed lines 42, can also be formed through one or both cover portions of sleeve 12 without removing a portion of the peripheral edge 40.

Card 11 includes arcuate peripheral edge 25 and a circular front face or side 19 and a back face or side (not visible). The shape and dimension of the back face is equivalent to that of the front face 19. The back face is parallel to the front face 19. The back face and front face 19 co-terminate along circular peripheral edge 25.

Rivet 16 extends through the front 13 and back cover portions and through the center of circular card 11 so that card 11 can be rotated about rivet 16 and inside sleeve 12 in the directions indicated by arrows A. A user rotates card 11 by gently grasping sleeve 12, by pressing a finger against the portion of peripheral edge 25 along the portion 15 of card 11 visible in semi-circular cut out 14, and by displacing the finger and edge 25 in one of the directions indicated by arrow A. Card 11 can also be rotated by simply grasping and turning the portion of card 11 above edges 26 and 27 in FIG. 1.

The first clue word grouping 22 of words comprises clues to the identity of the object 20, 21. These clues are read by a first player to a second player who is attempting to identify an object.

The drawing 21 and word 20 identify the object (subject) which the second player is attempting to identify. Consequently, the first player does not read the word "EAGLE" to the second player and does not describe the drawing 21 to the second player.

The second information word grouping 23 of words comprises background information or data that is available to the first player when the second player asks the first player informational questions about characteristics of the object that the second player is attempting to identify.

The informational questions asked of the first player by the second player must be capable of being answered "YES" or "NO" by the first player. The second player can continue to ask "YES" or "NO" informational questions until he asks a total of five (5) questions which are answered "NO". The "YES" or "NO" informational questions do not inquire into the specific identity of the object. For example, the following question is not an informational question:

"Is the object an eagle?"

Some sample informational questions are:

"Is the object a living thing?"

"Is the object an animal?"

"Does the animal live in Africa?"

"Does the animal live in North America?"

"Is the object a bird?"

"It is a large bird?"

"Does the bird have a large wingspan?"

"Is it a brown bird?"

"Is the bird a carnivore?"

The second player can at any time ask an identification question which inquires into the specific identity of the object:

"Is the object an eagle?"

If the first player answers the identification question "Yes" then the second player wins. If the first player answers the identification question "No", then the second player loses. If the second player wins, the first player can select a new object and repeat the game, or, the first player can select a new object and give a third player the chance to identity the object by providing the third player with the clues, by permitting the third player to ask "YES" and "NO" informational questions, and by permitting the third player to ask one identification question to attempt to identify the object. If the second player loses, then the first player selects a new object and gives a third player the chance to identify the new object, or, the first player gives the third player the chance to ask informational questions and an identification question in an attempt to identify the object that the second player did not correctly identify.

In FIG. 1, on card 11 object 20 and 21 is visible, along with its associated group 22 of clue words and group 23 of background information or data words. Object 20, 21 and groups 22, 23 are imprinted or otherwise formed on portions of face 19. A second object, along with its associated groups of clue words and background words, is formed on portions of face 19 which are not visible in FIG. 1 because those portions of face 19 are obscured by cover portion 13 of sleeve 12. If card 11 is rotated in one of the directions indicated by arrow A, the portions of card 11 with object 20 and 21 and word groups 22 and 23 turn into and are obscured by sleeve 12, while the portions of card 11 bearing the second object and the word groups associated with the second object turn out of sleeve 12, generally occupy the position shown in FIG. 1 for eagle 20, 21 and groups 22 and 23, and become visible. Accordingly, simply turning card 11 brings a second object (and its associated clue and background information word groups) into view which is used to continue play of the game of the invention. Similarly, if desired at least one object, along with its associated clue word group and informational word group, can be imprinted or otherwise formed on the back face of card 11, so that the game can be continued by turning over the game unit 10 of FIG. 1 to bring into view an object and associated word groups formed on the back face of card 11.

As used herein, a "word" consists of one or more alphanumeric symbols. For example, if the object is Christopher Columbus, each of the following can be utilized as a clue:

| | |
|---|---|
| | 1492<br>Ahoy!<br>Nina |
| Or as informational data: | |
| | 3 ships<br>Spain<br>America<br>Atlantic Ocean |

The card 11 and sleeve can have any desired shape and dimension. Card 11 can be utilized separately from a sleeve 12. Paper, plastic, or any other desired material can be utilized to make card 11, sleeve 12, and rivet. Card 11 need not be attached to sleeve 12, but can simply be stored in sleeve 12 and then removed from or turn in sleeve 12. A plurality of cards 11 can be stored in sleeve 12. Sleeve 12 need not have a front portion 13 and a back portion, but can, when the object 20 and 21 and groups 22 and 23 are formed on front face 19, include only a front portion 13. Sleeve 12 can include only a back portion. Instructions 43 are imprinted or otherwise formed on portion 13 of sleeve 13. Alphanumeric characters 17 "CLUES" or other symbols are formed on front portion 13 to identify the function of the words in group 22. Characters 17 can, if desired, be formed on card 11. Alphanumeric characters 18 "DATA to Help Answer ?'s" or other symbols are formed on front portion 13 to identify the function of the words in group 23. Characters 18 can, if desired, be formed on card 11.

Each object 20, 21 used on a card 11 can come from any subject including, but not limited to animals, sports, cars, countries, science, people, industries, laws, scriptures, beliefs, times, history, etc. Particular subjects or categories can be color coded. For example, each animal can have a green dot or bar formed on card 11 next to the object 20, 21; countries on the same continent can have a red dot or bar formed on card 11; etc.

Card 11 can include a raised area(s) which fit into and interlock with a depressed area (s) in sleeve 12 (or vice-versa) so that card 11 tends to "lock" temporarily into a position in which one subject and its associated word groups are visible.

If desired, a trademark, advertisement, or other promotional information can be imprinted on card 11 and sleeve 12.

The following example is provided to demonstrate, and not limit the scope of, the invention.

EXAMPLE

A game unit is provided. The game unit can comprise a single card or a plurality of cards, each with at least one object 20 and 21 and its associated word groups 22, 23 formed thereon. For sake of this example, however, the game unit comprises the unit 10 illustrated in FIG. 1.

Three players are selected to play the game. The game can be played with two or more players.

The $1^{st}$ player is selected to be the moderator, and is given game unit 10 In a computer version of the game, the computer acts as the moderator and has the information contained on game unit 10 in memory.

The $1^{st}$ player selects 28 the object to be identified (FIG. 2) by rotating card 11 in the direction(s) indicated by arrows A until the object 20, 21 and its associated word groups 22 and 23 are visible in the manner shown in FIG. 1. In the earlier mentioned computer version of the game, the computer selects at random the object to be identified.

A $2^{nd}$ second player is selected 29 to be the first to attempt to identify the selected object.

The $1^{st}$ player gives 30 the clues for the selected object by reading out loud to the $2^{nd}$ and $3^{rd}$ players the words:

"Winged. National. Regal."

In the computer version of the game, the computer causes these words to appear on the computer screen.

The 2nd player asks 31 the 1st player "YES" and "NO" information questions:

| | |
|---|---|
| 2nd player: | "Is the object a non-living thing?" |
| 1st player: | "No." |
| 2nd player: | "Is the object a human being?" |
| 1st player: | "No." |
| 2nd player: | "Is the object an animal?" |
| 1st player: | "Yes." |
| 2nd player: | "Is the animal smaller than a racoon?" |
| 1st player: | "No." |
| 2nd player: | "Does the animal eat insects?" |
| 1st player: | "No." |
| 2nd player: | "Does the animal hunt at night?" |
| 1st player: | "No." |

In the computer version of the game, the 2nd player asks the foregoing questions to the computer instead of the 1st player because the computer fills the role of the first player. The 2nd player can ask the questions to the computer by typing them on the computer keyboard or, if the computer has voice recognition software, by speaking to the computer. Software in the computer answers the question. If the software can not answer a question, the software causes the message "Ask another question." to appear on the computer display. If the computer has the information necessary to answer a questions, it answers "YES" or "NO".

The 2nd player loses because the 2nd player asked 32, without correctly guessing the object, five (5) information questions which were answered "NO". The second player loses 32. The 1st player continues 34 the game with the 3rd player. The 3rd player (like the second player before) can ask 31 the 1st player "YES" and "NO" information questions until the 3rd player accumulates five (5) "NO" answers to information questions and can, at any time, as an identification question.

| | |
|---|---|
| 3rd player: | "Is the animal a bird?" |
| 1st player: | "Yes." |
| 3rd player: | "Is the animal a hawk?" |
| 1st player: | "No." |

In the computer version of the game, the computer takes the place of the 1st player and answers the questions posed above by the 3rd player.

Since the 3rd player incorrectly guessed 36 the identity of the object, the third player loses. If there were any remaining players (i.e., a 4th player), the remaining player would be given the opportunity to identify the object. Instead, in this variation of the game, the play returns to the 2nd player:

| | |
|---|---|
| 2nd player: | "Does the bird eat mice?" |
| 1st player: | "Yes." |
| 2nd player: | "Is the bird an eagle?" |
| 1st player: | "Yes." |

In the computer version of the game, the 2nd player asks the foregoing questions to the computer, and not to another player. As noted, the computer fills the role of the 1st player.

The 2nd player wins because he or she asked 33 fewer than five (5) questions which were answered "NO" by the first player, and because the 2nd player correctly guessed 35 the identity of the object.

The 1st player can continue as the moderator and use the game unit 10 to question the other players, or, the 1st player can give the game unit 10 to the 2nd or 3rd player so that the moderator can have the opportunity to identify an object on the game unit.

The 1st player elects to continue being the moderator. The 1st player turns card 11 so that a new subject is visible, along with the clue word group and information word group associated with the subject. Since the 2nd player won, the 3rd player is first given the opportunity to ask the moderator "YES" and "NO" questions to attempt to identify the new subject. Or, if desired, since the 2nd player won, the 2nd player can first be given the opportunity to identify first the new subject selected by the moderator. If each subject on card 11 has already been used in the game, the 1st player can select a new card 11, along with the sleeve 12 accompanying the card. Also, as earlier noted, cards 11 may be available which are not in a sleeve 12. Or, a plurality of cards 11 can be loosely stored in, and not attached to, a sleeve 12.

One advantage of the game of the invention is that it enables the player asking "YES" and "NO" questions to exercise his or her deductive reasoning.

Another advantage of the game of the invention is that it forces the moderator (the one holding the game unit 10 and answering "YES" and "NO" questions) to read the words in the information group 23 and to learn about the object 20 and 21.

A further advantage of the invention is that it forces the moderator to do more than determine if the answer to a question is correct. Instead, the moderator must listen to questions, read the words in group 23, and determine whether the questions can be answered "YES" or "NO".

Still another advantage of the invention is that the game unit is small, inexpensive, and readily transported.

Yet a further advantage of the invention is that the game of the invention can be played even if one of a group of cards is lost.

Yet still another advantage of the invention is that a game board is not required.

Another advantage of the invention is the game unit 10 is fun for youngsters to operate.

A further advantage of the invention is that the game can be inconspicuously and easily played while traveling, while in a classroom, and while in a restaurant.

Still another object of the invention is that the moderator is forced to correlate background information with a picture of the selected object.

Having described my invention in such terms as to enable those of skill in the art to make and practice it, and having described the presently preferred embodiments thereof, I claim:

1. A method of playing a game, comprising the steps of:

(a) providing a game unit consisting of (i) a sleeve, (ii) at least one game card rotatably mounted in said sleeve, (iii) at least first and second selected subjects identified on said card, (iv) word clues on said card to facilitate the identification of each of said selected subjects, and (v) words comprising background information concerning each of said selected subjects, said first subject and said word clues and background information for said first subject being grouped on a first portion of said card, said second subject and said word clues and background information for said second subject being grouped on a second portion of said card different from said first portion, said sleeve being shaped and dimensioned such that only one of a pair comprising (vi) said first subject and said word clues and background information for said first subject, and (vii) said second subject and said word clues and background information for said second subject, can be viewed at a time and such that the one of said pair not being viewed is concealed by said sleeve, said word clues including words that symbolize and communicate a meaning without being divisible into smaller units capable of independent use;

(b) selecting at least one first and one second player;

(c) providing the game unit to the first player;

(d) selecting said first subject and manipulating said game unit such that said first subject, along with said word clues and background information for said first subject, are viewable;

(e) providing at least one of said clues on the game unit for said first subject to the second player by the first player;

(e) asking at least a first question of the first player by the second player to gain at least a portion of said background information about said first subject, said first player checking the correctness of the first question against said background information on the game unit for said first subject; and, (f) asking, according to a correct response by the first player to the first question, a second question of the first player by the second player to identify said first subject, said first player checking the correctness of the second question against said first subject on the game unit.

2. A game comprising (a) a sleeve, (b) game instructions on said sleeve, (c) at least one game card rotatably mounted in said sleeve and including information comprising, (i) at least a first selected subject identified on said card (ii) word clues on said card to facilitate the identification of said selected subject, and (iii) words comprising background information concerning said selected subject, said subject and said word clues and background information for said subject being grouped on a first portion of said card, said sleeve being shaped and dimensioned such that said card can be moved between two operative positions, (d) a first operative position in which said subject and said word clues and background information for said subject are not covered by said sleeve and are viewable, and (e) a second operative position in which said subject and said word clues and background information are covered by said sleeve, said word clues including words that symbolize and communicate a meaning without being divisible into smaller units capable of independent use, the playing of the game only requiring said instructions and said information on said game card, (f) said background information about said selected subject confirming to a player of the game involving at least one question concerning said background information the correctness of the question in identifying said background information, and (g) said word clues to the identification of said selected subject confirming to a player of the game involving at least one question concerning the identification of said selected subject the correctness of the question in identifying said selected subject.

3. A game comprising (a) a sleeve, (b) game instructions, (c) at least one game card rotatably mounted in said sleeve and including information comprising, (i) at least a first selected subject identified on said card, (ii) word clues on said card to facilitate the identification of said selected subject, and (iii) words comprising background information concerning said selected subject, said subject and said word clues and background information for said subject being grouped on a first portion of said card, said sleeve being shaped and dimensioned such that said card can be moved between two operative positions, (d) a first operative position in which said subject and said word clues and background information for said subject are not covered by said sleeve and are viewable, and (e) a second operative position in which said subject and said word clues and background information are covered by said sleeve, said word clues including words that symbolize and communicate a meaning without being divisible into smaller units capable of independent use, the playing of the game only requiring said instructions and said information on said game card, (f) said background information about said selected subject confirming to a player of the game involving at least one question concerning said background information the correctness of the question in identifying said background information, and (g) said word clues to the identification of said selected subject confirming to a player of the game involving at least one question concerning the identification of said selected subject the correctness of the question in identifying said selected subject.

* * * * *